US008942577B2

(12) United States Patent
Kanakubo

(10) Patent No.: US 8,942,577 B2
(45) Date of Patent: Jan. 27, 2015

(54) PRINTING APPARATUS AND CONTROL METHOD FOR PRINTING APPARATUS

(75) Inventor: Yukio Kanakubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 13/101,490

(22) Filed: May 5, 2011

(65) Prior Publication Data

US 2011/0280592 A1 Nov. 17, 2011

(30) Foreign Application Priority Data

May 11, 2010 (JP) ..... 2010-109545

(51) Int. Cl.
*G03G 15/08* (2006.01)
*G03G 15/00* (2006.01)
*G03G 15/01* (2006.01)

(52) U.S. Cl.
CPC ..... *G03G 15/556* (2013.01); *G03G 2215/0177* (2013.01); *G03G 15/553* (2013.01); *G03G 15/0121* (2013.01); *G03G 15/0173* (2013.01); *G03G 15/0163* (2013.01)
USPC ..... 399/27; 399/227

(58) Field of Classification Search
USPC ..... 399/12, 27–29, 226, 227
See application file for complete search history.

(56) References Cited

U.S. PATENT DOCUMENTS 5,887,217 A 3/1999 Mitekura
2004/0234282 A1 * 11/2004 Hamano et al. ..... 399/27

FOREIGN PATENT DOCUMENTS

| | | | |
|---|---|---|---|
| CN | 2667531 | A | 12/2004 |
| CN | 101334610 | A | 12/2008 |
| JP | H07-295358 | A | 11/1995 |
| JP | 9-179405 | A | 7/1997 |
| JP | 09-179405 | A | 7/1997 |
| JP | 10-078740 | A | 3/1998 |
| JP | 2003-323027 | A | 11/2003 |
| JP | 2006-047838 | A | 2/2006 |
| JP | 2006-113290 | A | 4/2006 |

* cited by examiner

*Primary Examiner* — Hoang Ngo
(74) *Attorney, Agent, or Firm* — Canon USA, Inc., IP Division

(57) ABSTRACT

A printing apparatus for performing printing using a recording material includes a plurality of storing units, a movement unit, and an execution unit. The plurality of storing units store the recording material. The movement unit moves one storing unit of the plurality of storing units to a replaceable position. The execution unit execute check processing for checking an operation of a storing unit if all of one storing unit or a plurality of the storing units determined to be lacking the recording material are moved to the replaceable position by the movement unit.

22 Claims, 7 Drawing Sheets

FIG.7

| | |
|---|---|
| Black | REPLACED |
| Cyan | |

PRINTING APPARATUS AND CONTROL METHOD FOR PRINTING APPARATUS

BACKGROUND OF THE INVENTION

1. Field of the Invention

The present invention relates to a printing apparatus that prints data by using a recording material and, in particular, to a printing apparatus having a plurality of storing units that store the recording material.

2. Description of the Related Art

Japanese Patent Application Laid-Open No. 2003-323027 discusses a printing apparatus that prints data by rotating and moving a plurality of toner cartridges, in which when toner is exhausted in one toner cartridge, the toner cartridge is then moved to a replaceable position, and a user can replace the toner cartridge.

Further, Japanese Patent Application Laid-Open No. 10-078740 discusses a printing apparatus, in which an initialization operation is executed, including an operation for checking whether a cartridge is properly loaded or whether a toner cartridge normally functions, after completion of the replacement of the toner cartridge.

In the printing apparatus that performs the initialization operation, it is checked whether the toner cartridge is properly loaded, or whether the toner cartridge is normally operated, while actually rotating the toner cartridge.

In a case where a user expressly designates a mode (hereinafter, referred to as a replacement mode) for replacing a toner cartridge via a button and replaces the toner cartridge, the user sequentially replaces toner cartridges as a target. Thereafter, the user ends the replacement mode. The printing apparatus executes the initialization operation in response to ending of the replacement mode.

Instead of transition to the replacement mode, when an exhausted toner cartridge can be replaced only by moving the exhausted toner cartridge to a replaceable position, an operation for opening/closing a door to replace the toner cartridge enables recognition of the replacement of the toner cartridge.

However, if, each time the user replaces one toner cartridge and closes the door while a plurality of toner cartridges is concurrently exhausted, the printing apparatus executes the initialization operation, the usability may decrease. This is because each time the user replaces the toner cartridge, the user needs to wait for the initialization operation to be completed.

SUMMARY OF THE INVENTION

The present invention is directed to improving usability by preventing the execution of check processing for checking an operation of a storing unit, for every replacement of storing units storing a recording material.

According to an aspect of the present invention, a printing apparatus for performing printing using a recording material; the printing apparatus includes a plurality of storing units configured to store the recording material, a movement unit configured to move one storing unit of the plurality of storing units to a replaceable position; and an execution unit configured to execute check processing for checking an operation of a storing unit if all of one storing unit or a plurality of the storing units determined to be lacking the recording material are moved to the replaceable position by the movement unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 illustrates an example of the replacement list.

DESCRIPTION OF THE EMBODIMENTS

Various exemplary embodiments, features, and aspects of the invention will be described in detail below with reference to the drawings.

Figure 1:
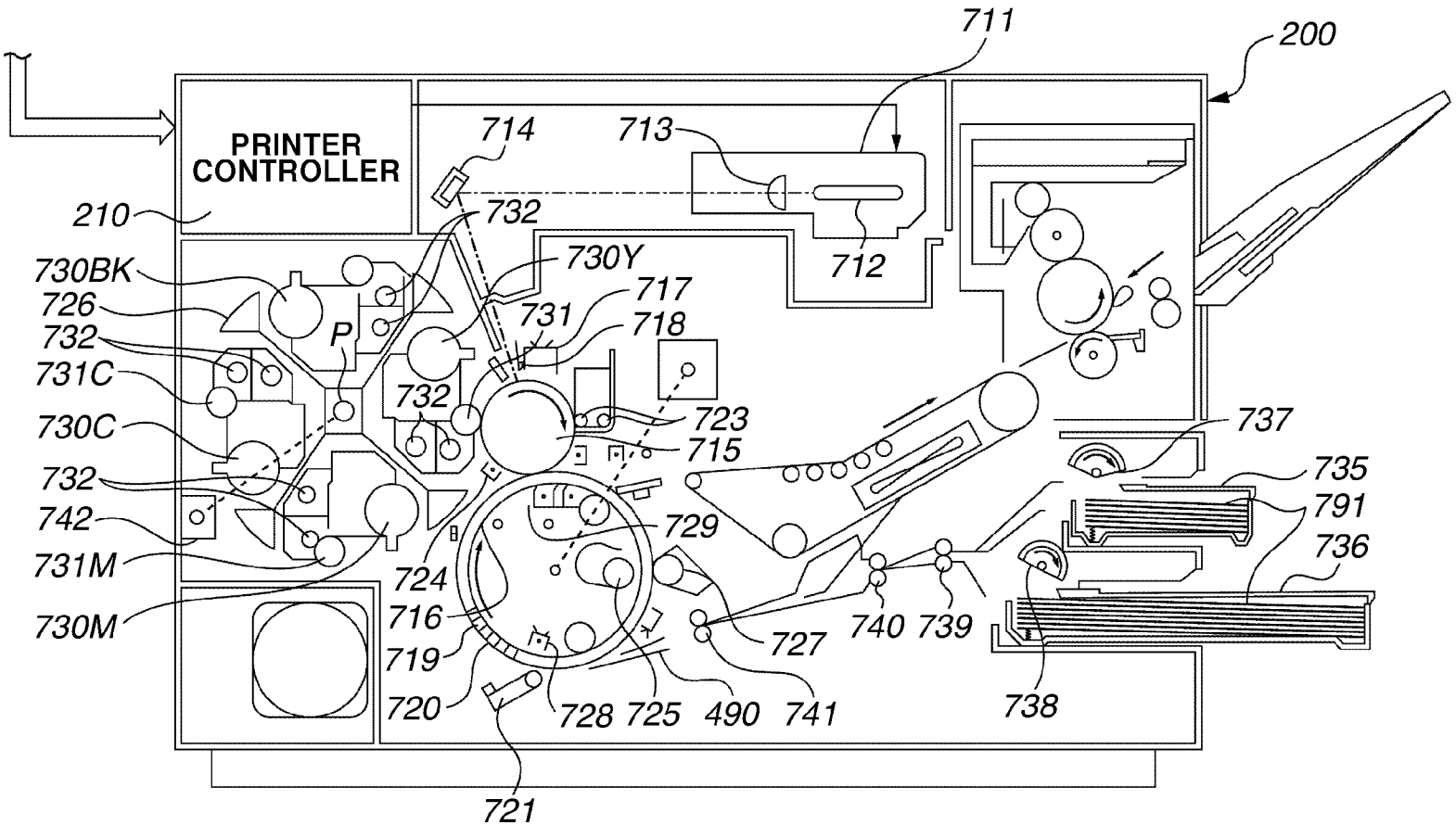
FIG. 1 illustrates an internal configuration of a color laser printer of the rotational developing rotary type as an example of a printing apparatus according to an exemplary embodiment.

FIG. 1 illustrates an internal configuration of a color laser printer of the rotational developing rotary type as an example of a printing apparatus 200 according to an exemplary embodiment. The printing apparatus 200 is illustrated as an example, using toner as a recording material for printing.

A scanner 711 includes a laser output unit (not illustrated) that converts an image signal from a printer controller 210 into an optical signal (laser beams), a polygon mirror 712 as an octahedral member, a motor (not illustrated) that rotates the polygon mirror 712, and an f/θ lens (image-forming lens) 713. The laser beams output from the laser output unit are reflected by one side surface of the polygon mirror 712, pass through the f/θ lens 713, reflect from a reflection mirror 714, and linearly raster-scan a surface of a photosensitive drum 715. The photosensitive drum 715 is rotated in the direction illustrated by an arrow. Thus, an electrostatic latent image corresponding to an image represented by the image signal is formed on the surface of the photosensitive drum 715. A primary charger 717, a whole-surface exposure lamp 718, a cleaner unit 723 for recovering the remaining toner that is not transferred to a sheet, and a pre-transfer charger 724 are arranged around the photosensitive drum 715.

A developing unit 726 develops the electrostatic latent image formed on the surface of the photosensitive drum 715 with the following configuration.

Toner hoppers 730Y, 730M, 730C, and 730Bk each contain toner as a developer. Screws 732 transmit the developers stored in the toner hoppers 730Y, 730M, 730C, and 730Bk to developing sleeves 731Y, 731M, 731C, and 731Bk. The developing sleeves 731Y, 731M, 731C, and 731Bk come into contact with the photosensitive drum 715, and develop images with the developers. More specifically, toner images are formed with yellow, magenta, cyan, and black developers on the photosensitive drum 715. The toner hoppers 730Y, 730M, 730C, and 730Bk, the developing sleeves 731Y, 731M, 731C, and 731Bk, and the screws 732 are arranged around a central axis P of the developing unit 726. Different colors Y, M, C, and Bk are yellow, magenta, cyan, and black, respectively. The toner cartridge for each color includes the toner hopper and the developing sleeve.

A position sensor 742 detects the rotational position of the developing unit 726. When forming a yellow toner image on the photosensitive drum 715, the developing unit 726 is rotated around the axis P as the center, and the photosensitive drum 715 comes into contact with the developing sleeve 731Y. FIG. 1 illustrates this state. When forming a magenta toner image, the developing unit 726 is rotated around the axis P as the center, and the photosensitive drum 715 comes into contact with the developing sleeve 731M. When forming cyan and black toner images, similar operations are performed.

A transfer drum 716 transfers the toner images formed on the photosensitive drum 715 to the sheet. An actuator plate 719 detects the movement position of the transfer drum 716. A position sensor 720, which is located close to the actuator plate 719, detects that the transfer drum 716 is moved to the home position. The actuator plate 719, the position sensor 720, a transfer drum cleaner unit 725, a sheet pressing roller 727, and a neutralization device 729 as a transfer charger are arranged around the transfer drum 716.

Sheet feeder cassettes 735 and 736 store sheets 791. The sheet feeder cassette 735 contains A4-size sheets, and the sheet feeder cassette 736 contains A3-size sheets. When the sheet is fed and conveyed, sheet feeder rollers 737 and 738 feed the sheets 791 from the sheet feeder cassettes 735 and 736. Timing rollers 739, 740, and 741 control the timing for feeding and conveying the sheets 791. The sheets 791 are guided to a sheet guide 743 via the timing rollers 739, 740, and 741. A gripper 728 carries the edge of the sheet and the sheet is wound around the transfer drum 716. One of the sheet feeder cassettes 735 and 736 is selected in response to an instruction from the printer controller 210. Only one of the sheet feeder rollers 737 and 738 corresponding to the selected sheet feeder cassette is rotated.

With the above-described configuration, full-color printing with four colors, Y, M, C, and Bk, is realized.

In the printing apparatus illustrated in FIG. 1, the printer controller 210 is closed or opened like a door and functions as a cover, at which a user can replace the toner cartridge.

Figure 2:
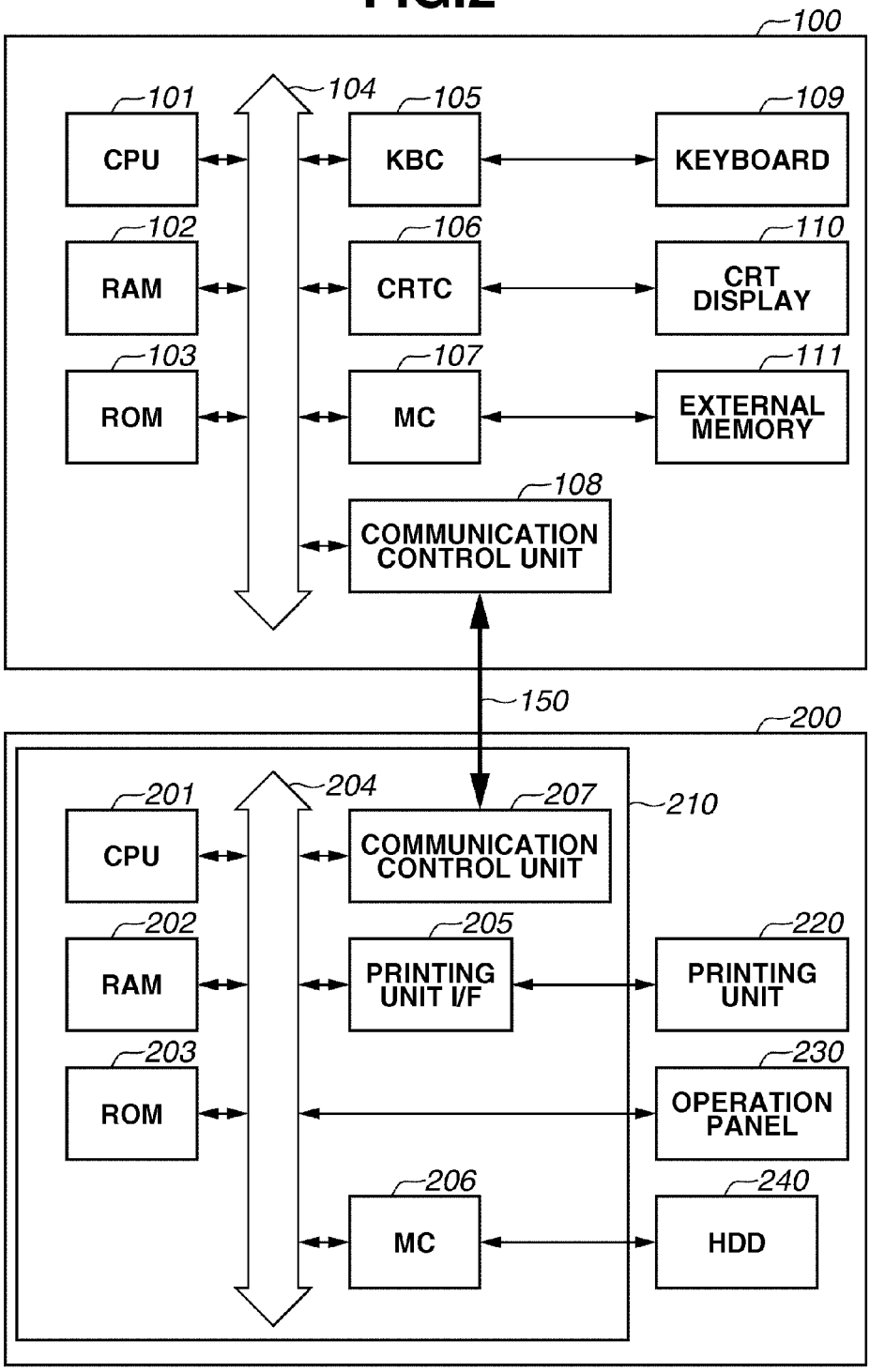
FIG. 2 is a block diagram illustrating a configuration of a printing system according to an exemplary embodiment.

FIG. 2 is a block diagram illustrating a configuration of a printing system according to an exemplary embodiment. In the printing system, a host computer 100 can communicate with the printing apparatus 200 via a communication medium 150. The communication medium 150 is an interactive interface, such as a local area network (LAN), a universal serial bus (USB) cable, or a wireless LAN.

A central processing unit (CPU) 101 processes a document mixedly having a graphic, an image, a character, or a table (including spreadsheet) based on a program stored in a read-only memory (ROM) 103 or a hard disk drive (not illustrated). The CPU 101 comprehensively controls devices connected to a system bus 104 based on the program stored in the ROM 103 or the hard disk drive.

A random access memory (RAM) 102 functions as a main memory or a work area for the CPU 101.

The ROM 103 includes a program ROM that stores various programs executed by the CPU 101, a font ROM that stores font data used for document processing, and a data ROM that stores various data used for document processing.

A keyboard controller (KBC) 105 controls a key input from a keyboard 109 or a pointing device (not illustrated), thereby transmitting contents of the key input to the CPU 101. A cathode ray tube (CRT) controller (CRTC) 106 controls a display operation on a cathode ray tube (CRT) display 110 in response to an instruction from the CPU 101. A memory controller (MC) 107 controls the access to an external memory 111 such as a hard disk, a compact disc (CD), or a digital versatile disc (DVD). The external memory 111 stores a boot program, various application programs, font data, a user file, or an editing file. A communication control unit 108 is connected to the printing apparatus 200 via the communication medium 150, and controls the communication with the printing apparatus 200.

The CPU 101 loads (performs rasterizing processing of) an outline font to a display random access memory (RAM) arranged on the RAM 102 to enable the execution of "What You See Is What You Get" (WYSIWYG) on the CRT display 110. The CPU 101 opens various registered windows and executes various data processing in response to a command instructed with a mouse cursor displayed on the CRT display 110.

A central processing unit (CPU) 201 comprehensively controls devices connected to a system bus 204 based on a program stored in a read-only memory (ROM) 203 or a hard disk drive (HDD) 240. The CPU 201 outputs an image signal to a printing unit 220 via a printing unit interface (printing unit I/F) 205 based on the program stored in the ROM 203 or the HDD 240, and controls the printing unit 220 to print an image represented by an image signal.

A random access memory (RAM) 202 functions as a main memory or a work area for the CPU 201. An optional RAM is connected to an expansion port (not illustrated), thereby expanding a memory capacity of the RAM 202. The RAM 202 is used as a drawing memory that stores image data converted from print data. The ROM 203 functions as a program ROM that stores a control program based on a flowchart illustrated in FIG. 5 or 6.

A communication control unit 207 is connected to the host computer 100 via the communication medium 150, and controls the communication with the host computer 100. The CPU 201 can communicate with the host computer 100 via the communication control unit 207, and can notify the host computer 100 of status information indicating the status of the printing apparatus 200.

An operation panel 230 includes a switch for operating the printing apparatus 200 by the user and a light-emitting diode (LED) display for displaying various information to the user. Further, the operation panel 230 may have a touch panel having a reception function of the operation and a display function of information.

A memory controller (MC) 206 controls the access to the HDD 240. The HDD 240 stores a program executed by the CPU 201 or print data received from the host computer 100.

Figure 3:
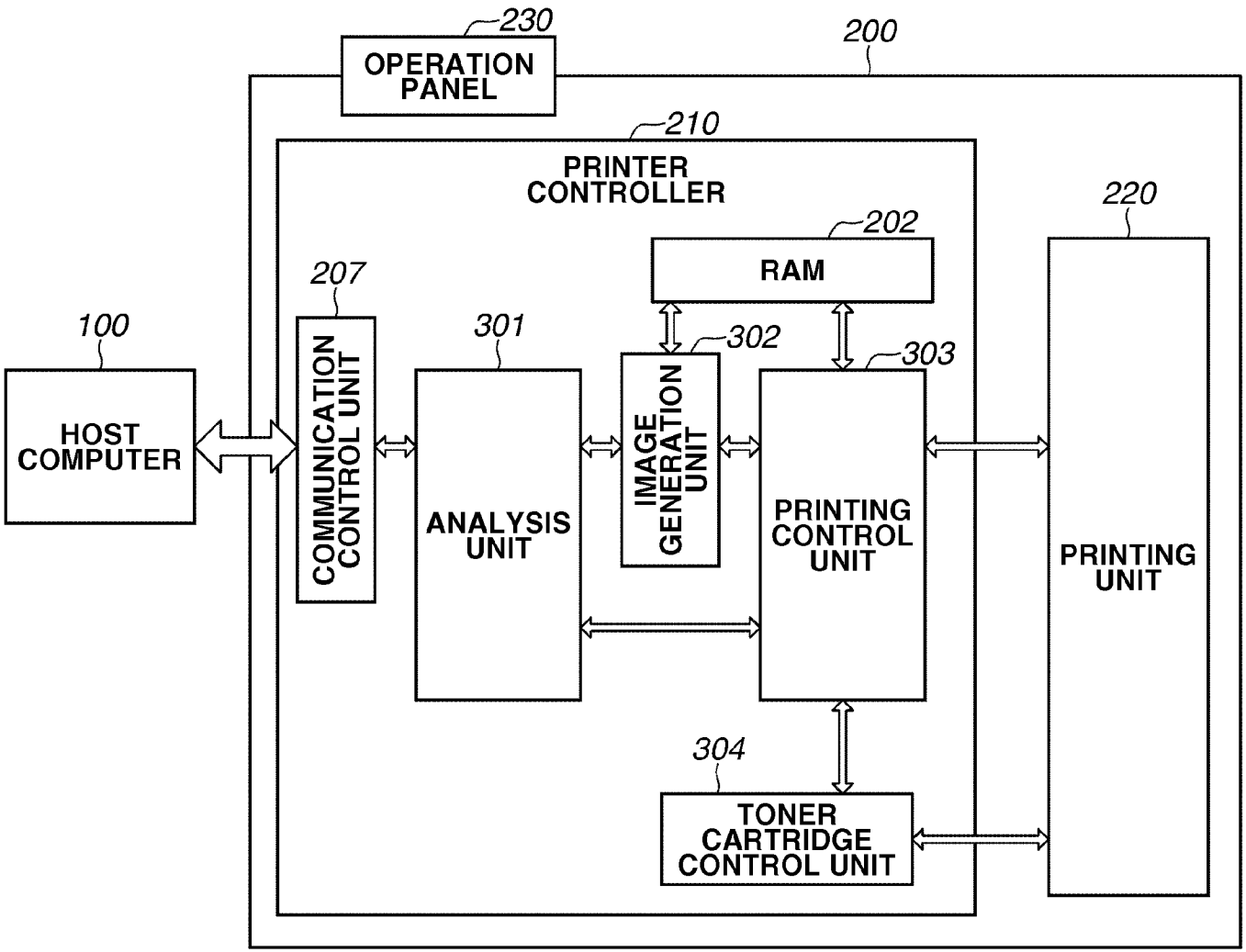
FIG. 3 is a block diagram illustrating a functional configuration for printer control by a central processing unit (CPU) in a printing apparatus in FIG. 2.

FIG. 3 is a block diagram illustrating a functional configuration of printer control by the CPU 201 in the printing apparatus 200 illustrated in FIG. 2. Referring to FIG. 3, the CPU 201 executes the program, thereby implementing an analysis unit 301, an image generation unit 302, a printing control unit 303, and a toner cartridge control unit 304.

The communication control unit 207 receives print data or a control command from the host computer 100, and transmits the data or command to the analysis unit 301. The analysis unit 301 includes a control program conforming to a control command system or a control program conforming to a print control language used for print data. Therefore, the analysis unit 301 interprets print data for drawing a character, graphic, or image, and transmits printing information based on the interpretation result to the image generation unit 302. The analysis unit 301 interprets a control command for instructing the selection of the sheet feeder cassette or the resetting of the printing unit 220, and sends the instruction based on the interpretation to the printing control unit 303.

The image generation unit 302 develops objects such as a character, a graphic, and an image to a bit map based on the printing information from the analysis unit 301, and stores bit map data on the RAM 202.

The printing control unit 303 controls the printing unit 220 according to the instruction from the analysis unit 301, converts the bit map data stored in the RAM 202 into a video signal (image signal), and outputs the video signal to the printing unit 220.

Figure 5:
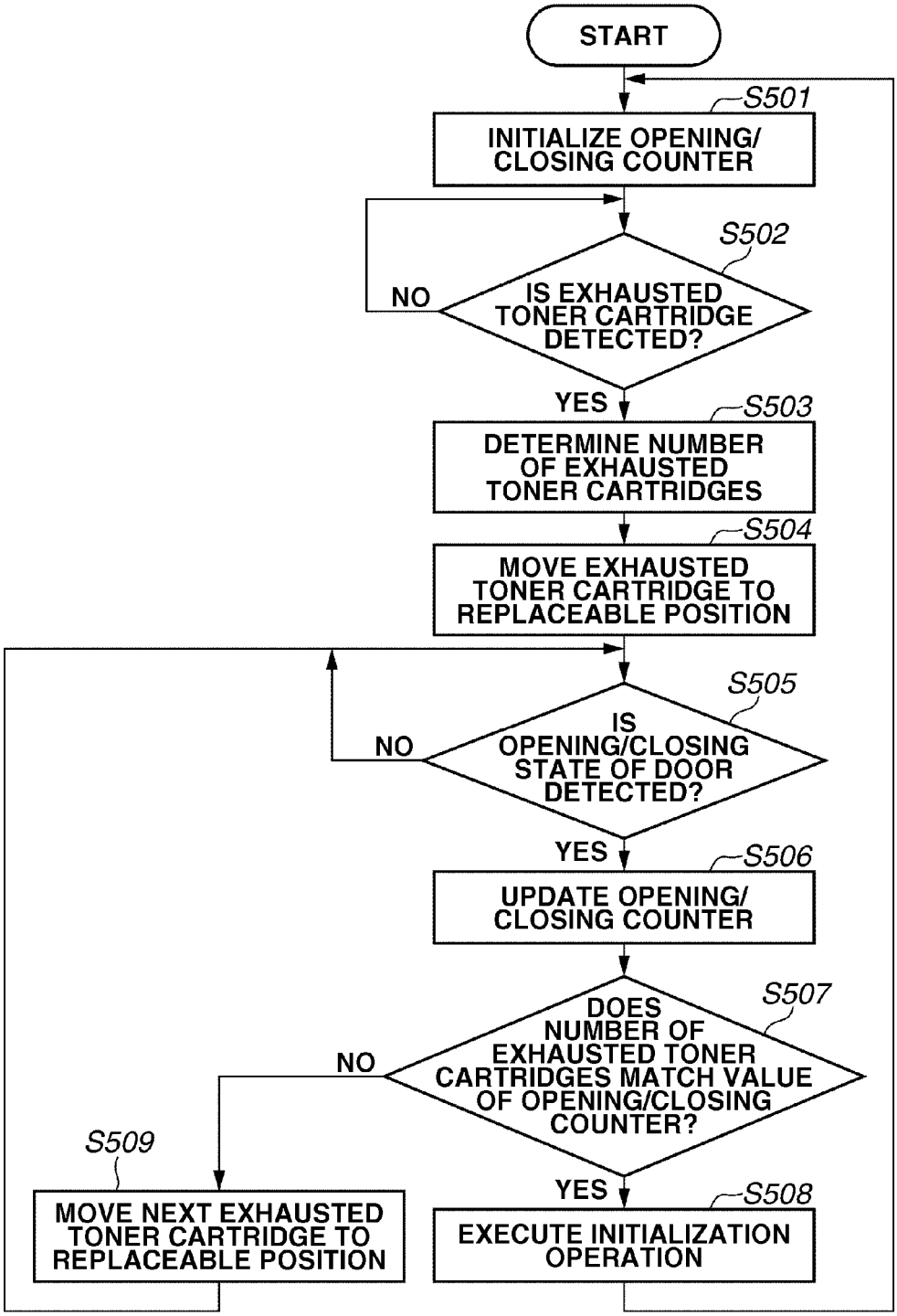
FIG. 5 is a flowchart of processing by a toner cartridge control unit.

The toner cartridge control unit 304 moves the toner cartridge to the printing unit 220, and causes the printing unit 220 to execute the initialization operation, thus executing processing illustrated in FIG. 5.

The printing unit 220 receives a video signal from the printing control unit 303, and prints an image represented by the video signal on a sheet. An example of printing processing by the printing unit 220 is described above with reference to FIG. 1.

Figure 4:
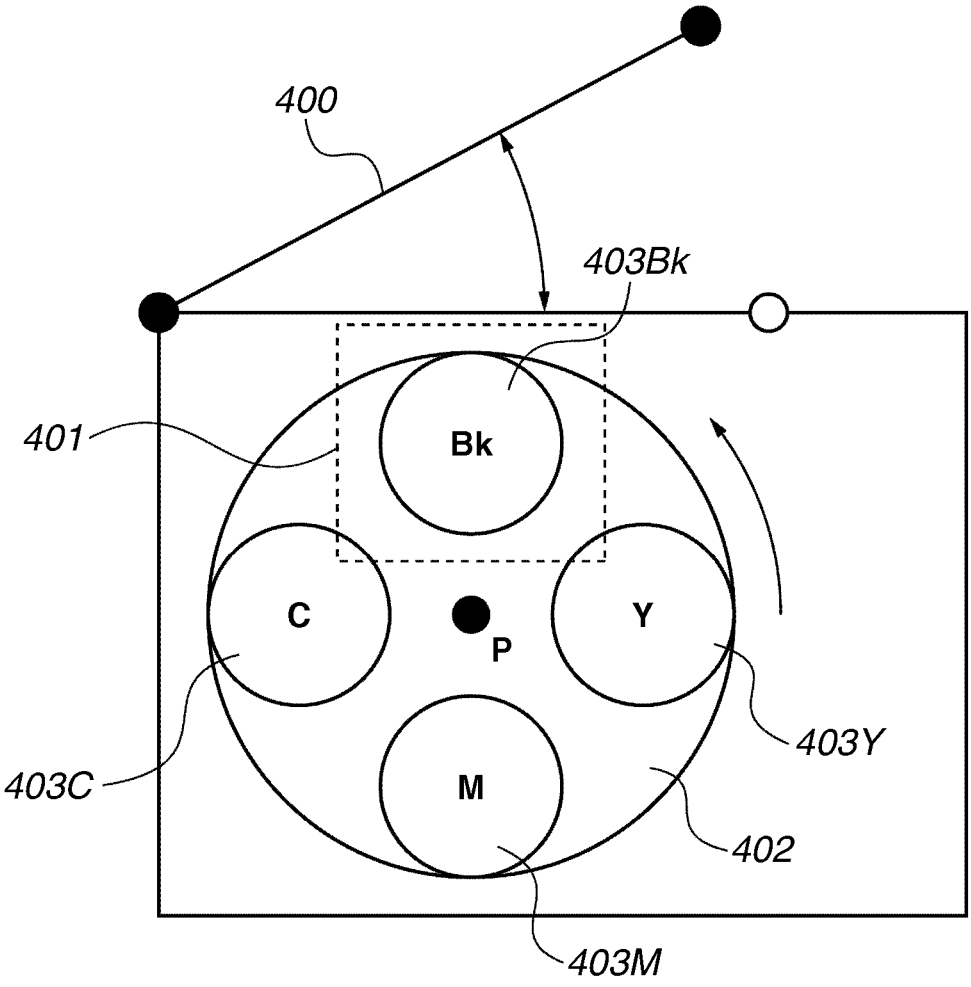
FIG. 4 illustrates a method for replacing a toner cartridge in the color laser printer of the rotational developing rotary type.

FIG. 4 illustrates a method for replacing the toner cartridge in the color laser printer of the rotational developing rotary type.

When the toner cartridge is replaced, the user opens a door 400. The door functions as a cover. When the door 400 is opened, a position 401 just below the door 400 then becomes a position for replacing the toner cartridge (hereinafter, referred to as a replaceable position), and the user can replace the toner cartridge located at the position 401. The replaceable position of the toner cartridge is not limited to the example illustrated in FIG. 4, and may be varied depending on the configuration of the printing apparatus 200.

The toner cartridge 403C is for cyan, the toner cartridge 403M is for magenta, the toner cartridge 403Y is for yellow, and the toner cartridge 403Bk is for black. In the example illustrated in FIG. 4, the toner cartridge 403Bk is located at the replaceable position.

The toner cartridges 403C, 403M, 403Y, and 403Bk are attached to a developing unit 402, which is rotatable around the central axis P. The toner cartridge control unit 304 issues a control command to the printing unit 220, thereby rotating the developing unit 402 to move an arbitrary toner cartridge to the replaceable position.

After replacing the toner cartridge, the execution of the initialization operation is required. In the initialization operation, a drive portion of the developing unit 402 is actually operated, and it is checked whether a toner cartridge for intended color is correctly attached to the developing unit 402, whether there is a defect, or whether the function is normally operated. In a case where there is a possibility that the toner cartridge has been replaced, the execution of the initialization operation is required before executing printing.

FIG. 5 is a flowchart of processing by the toner cartridge control unit 304. In the processing, a toner cartridge that is determined to be lacking in toner is moved to the replaceable position, and the user is prompted to replace the toner cartridge. Then, check processing is executed to check the operation of the toner cartridge.

In step S501, the toner cartridge control unit 304 initializes, to 0, a counter (hereinafter, referred to as an opening/closing counter) for counting the number of times of opening/closing of the door 400.

In step S502, the toner cartridge control unit 304 determines whether an exhausted toner cartridge is detected. The printing unit 220 includes a sensor that detects whether the toner is present or absent for each of a plurality of toner cartridges, and transmits a signal indicating the detection result to the toner cartridge control unit 304. Thus, the toner cartridge control unit 304 determines in which toner cartridge the toner is exhausted by checking the signal transmitted from the printing unit 220. According to the present exemplary embodiment, it is determined by detecting the toner exhaustion that a toner cartridge is lacking in toner.

When detecting the exhausted toner cartridge (YES in step S502), then in step S503, the toner cartridge control unit 304 determines, based on the signal from the printing unit 220, how many exhausted toner cartridges there are. In step S504, the toner cartridge control unit 304 transmits a control command for moving one exhausted toner cartridge or one of a plurality of exhausted toner cartridges to the replaceable position to the printing unit 220. It is not limited to first move the toner cartridge for which color to the replaceable position, and any movement order may be used.

In step S505, the toner cartridge control unit 304 determines whether the opening/closing state of the door 400 is detected. The printing unit 220 has a sensor that detects the opening/closing state of the door 400, and transmits a signal indicating the detection result to the toner cartridge control unit 304.

When detecting the opening/closing state of the door 400 (YES in step S505), then in step S506, the toner cartridge control unit 304 increments the opening/closing counter by one to update the opening/closing counter. According to the present exemplary embodiment, the toner cartridge control unit 304 determines that the toner cartridge has been replaced based on the opening/closing state of the door 400.

In step S507, the toner cartridge control unit 304 compares the number of exhausted toner cartridges determined in step S503 with a value of the opening/closing counter, and determines whether the number of exhausted toner cartridges matches the value of the opening/closing counter.

When the number of exhausted toner cartridges matches the value of the opening/closing counter (YES in step S507), then in step S508, the toner cartridge control unit 304 causes the printing unit 220 to execute the initialization operation.

When the number of exhausted toner cartridges does not match the value of the opening/closing counter (NO in step S507), then in step S509, the toner cartridge control unit 304 transmits a control command for moving the next exhausted toner cartridge to the replaceable position to the printing unit 220. Then, the toner cartridge control unit 304 waits for the next opening/closing state of the door 400.

In the processing illustrated in FIG. 5, the toner cartridge control unit 304 predicts that all the exhausted toner cartridges have been replaced at the current time, based on the opening/closing state of the door 400, and executes the initialization operation based on the prediction. Therefore, it is possible to omit a wasting operation, e.g., execution of the initialization operation each time the toner cartridge is replaced.

In the processing illustrated in FIG. 5, the toner cartridge control unit 304 predicts whether all the exhausted toner cartridges have been replaced, based on the number of times of opening/closing of the door 400. However, only the opening/closing operation of the door 400 may be performed without replacing the exhausted toner cartridge. In other words, even when the number of exhausted toner cartridges matches the value of the opening/closing counter, not all the exhausted toner cartridges may have been replaced. To address this situation, after the number of exhausted toner cartridges matches the value of the opening/closing counter, the initialization operation can be executed each time the door 400 is opened and closed. As a consequence, it is possible to execute the initialization operation without fail after the replacement of the toner cartridges.

Figure 6:
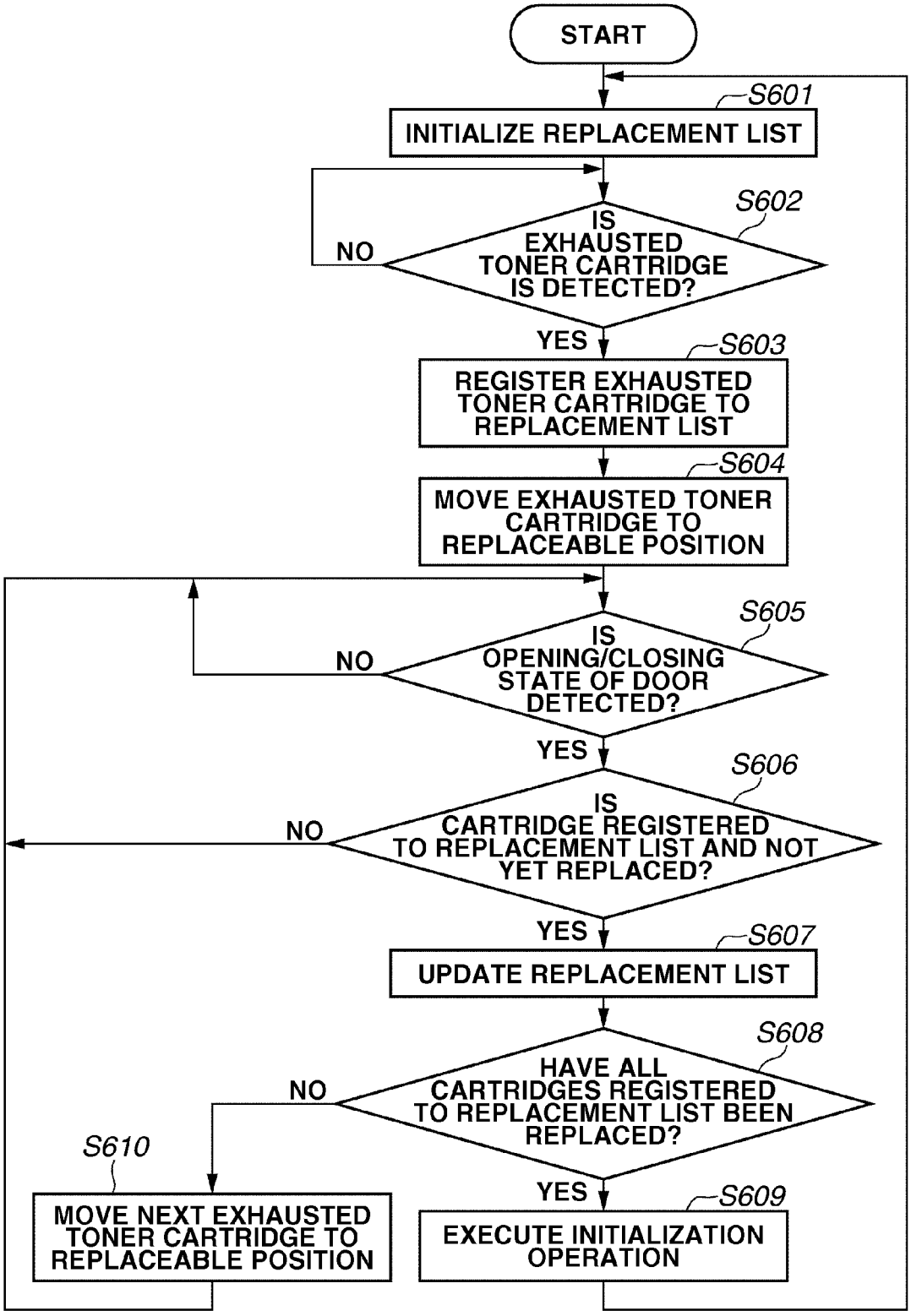
FIG. 6 is a flowchart of processing by the toner cartridge control unit using a replacement list.

In place of the opening/closing counter, a replacement list can be used. FIG. 6 is a flowchart of processing by the toner cartridge control unit 304 using the replacement list.

Although the toner cartridge control unit 304 transmits a control command for moving the toner cartridge to the replaceable position to the printing unit 220, the user may open and close the door 400 before the toner cartridge is moved to the replaceable position. To address this situation, in the processing illustrated in FIG. 6, not only the opening/closing state of the door 400 is checked but also it is checked whether the exhausted toner cartridge is located at the replaceable position to determine the execution timing of the initialization operation.

In step S601, the toner cartridge control unit 304 initializes the replacement list. The replacement list stores information on exhausted toner cartridges and also stores information indicating which toner cartridge has been replaced.

FIG. 7 illustrates an example of the replacement list. The replacement list illustrated in FIG. 7 indicates that the toner exhaustion is detected in the toner cartridges for black and cyan, and the toner cartridge for black has been already replaced. The replacement list is stored in the RAM 202.

In step S602, the toner cartridge control unit 304 determines whether an exhausted toner cartridge is detected. When the toner cartridge control unit 304 detects the exhausted toner cartridge (YES in step S602), then in step S603, the toner cartridge control unit 304 recognizes one or a plurality of exhausted toner cartridges based on the signal from the printing unit 220, and registers the recognized toner cartridge to the replacement list.

In step S604, the toner cartridge control unit 304 transmits a control command for moving one exhausted toner cartridge or one of a plurality of exhausted toner cartridges to the replaceable position to the printing unit 220. It is not limited to first move the toner cartridge for which color to the replaceable position, and any movement order may be used.

In step S605, the toner cartridge control unit 304 determines whether the opening/closing state of the door 400 is detected. When the toner cartridge control unit 304 detects the opening/closing state of the door 400 (YES in step S605), then in step S606, the toner cartridge control unit 304 recognizes which toner cartridge is currently located at the replaceable position, and determines whether the toner cartridge is registered to the replacement list and is not yet replaced.

When the toner cartridge control unit 304 determines that the toner cartridge located at the replaceable position is not registered to the replacement list (NO in step S606), the user may have opened and closed the door 400 before the exhausted toner cartridge is moved to the replaceable position. When the toner cartridge located at the replaceable position is currently registered to the replacement list but has already been replaced (NO in step S606), the user may have opened and closed the door 400 before the next exhausted toner cartridge is moved to the replaceable position. Therefore, in these cases, in step S605, the toner cartridge control unit 304 waits the door 400 to be opened and closed again.

When the toner cartridge located at the replaceable position is currently registered to the replacement list and is not yet replaced (YES in step S606), then in step S607, the toner cartridge control unit 304 updates the current state of the toner cartridge located at the replaceable position to "already replaced" in the replacement list. Thus, the toner cartridge control unit 304 determines that the door 400 has been opened and closed as the user has replaced the toner cartridge.

In step S608, the toner cartridge control unit 304 updates the replacement list, and then determines whether all the toner cartridges registered to the replacement list have been replaced.

When the toner cartridge control unit 304 determines that all the toner cartridges registered to the replacement list have been replaced (YES in step S608), then in step S609, the toner cartridge control unit 304 causes the printing unit 220 to execute the initialization operation. On the other hand, when the toner cartridge control unit 304 determines that not all the toner cartridges registered to the replacement list have been replaced (NO in step S608), then in step S610, the toner cartridge control unit 304 transmits a control command for moving the next exhausted toner cartridge to the replaceable position to the printing unit 220. Then, in step S605, the toner cartridge control unit 304 waits the door 400 to be opened and closed next.

In the processing illustrated in FIG. 6, not only the opening/closing state of the door 400 is checked but it is checked which toner cartridge is located at the replaceable position at the time of opening/closing of the door 400. Thus, the accuracy for predicting the end of replacement of the toner cartridge is improved, and unnecessary execution of the initialization operation can be reduced.

According to the above-described exemplary embodiment, it is possible to prevent check processing of an operation of a container unit containing a recording material from being executed each time the container unit is replaced. As a consequence, usability can be improved.

Aspects can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium). In an example, a computer-readable medium may store a program that causes a printing apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-109545 filed May 11, 2010, which is hereby incorporated by reference herein in its entirety.

What is claimed is:

1. A printing apparatus for performing printing using a recording material which is stored in at least one of a plurality of storing units configured to store the recording material, the printing apparatus comprising:

a movement unit configured to move one storing unit of the plurality of storing units to a replaceable position;

a control unit configured to cause the movement unit to move at least one of the plurality of storing units to the replaceable position based on determining that the at least one of the plurality of storing units is lacking the recording material;

a detection unit configured to detect closing of a cover that is openable to replace the at least one storing unit moved to the replaceable position; and a counting unit configured to count a number of times closing of the cover is detected by the detection unit in a case where at least one of the plurality of the storing units is determined to be lacking the recording material, wherein the control unit is configured to execute check processing for checking the at least one storing unit after comparing a number of plural storing units determined to be lacking the recording material with the number of times counted by the counting unit.

2. The printing apparatus according to claim 1, wherein the control unit executes the check processing based on the number of plural storing units determined to be lacking the recording material matching the number of times counted by the counting unit.

3. The printing apparatus according to claim 2, wherein, after determining that the number of plural storing units determined to be lacking the recording material matches the number of times counted by the counting unit, the execution unit executes the check processing each time the cover is closed.

4. The printing apparatus according to claim 2, wherein the control unit is configured to cause the movement unit to move one of the plural storing units determined to be lacking the recording material to the replacement position based on determining that the number of plural storing units determined to be lacking the recording material and the number of times counted by the counting unit do not match each other.

5. The printing apparatus according to claim 2, wherein the check processing checks whether the at least one storing unit is correctly attached, checks whether there is a defect, or checks whether the at least one storing unit is normally operated.

6. A printing apparatus for performing printing using a recording material which is stored in at least one of a plurality of storing units configured to store the recording material, the printing apparatus comprising:

a movement unit configured to move one storing unit of the plurality of storing units to a replaceable position;

a control unit configured to cause the movement unit to move at least one of the plurality of storing units to the replaceable position based on determining that the at least one of the plurality of storing units is lacking the recording material;

a detection unit configured to detect closing of a cover that is openable to replace the at least one storing unit moved to the replaceable position;

a storage unit configured to store information indicating whether each of plural storing units determined to be lacking the recording material has been replaced; and an updating unit configured to store, in the storage unit, information indicating that a storing unit moved to the replacement position has been replaced in a case where closing of the cover is detected by the detection unit, wherein the control unit is configured to execute check processing for checking the first storing unit based on the information stored in the storage unit indicating that the plural storing units determined to be lacking the recording material have been replaced.

7. The printing apparatus according to claim 6, wherein, in a case where the information stored in the storage unit indicates that the storing unit of the plural storing units determined to be lacking the recording material has not been replaced, the control unit is configured to cause the movement unit to move the storing unit of the plural storing unit determined to be lacking the recording material to the replacement position.

8. The printing apparatus according to claim 6, wherein the check processing checks whether the at least one storing unit is correctly attached, checks whether there is a defect, or checks whether the at least one storing unit is normally operated.

9. A printing apparatus for performing printing using a recording material which is stored in at least one of a plurality of storing units configured to store the recording material, the printing apparatus comprising:

a movement unit configured to move one storing unit of the plurality of storing units to a replaceable position;

a control unit configured to cause the movement unit to move at least one of the plurality of storing units to the replaceable position based on determining that the at least one of the plurality of storing units is lacking the recording material; and a determination unit configured to determine whether a number of plural storing units determined to be lacking the recording material and a number of storing units determined to be replaced match each other, wherein the control unit is configured to cause the movement unit to move a storing unit of the plural storing units to the replaceable position based on determining that the number of plural storing units determined to be lacking the recording material and the number of storing units determined to be replaced do not match each other, and execute check processing for checking the storing unit based on determining that the number of plural storing units determined to be lacking the recording material and the number of storing units determined to be replaced match each other.

10. The printing apparatus according to claim 1, further comprising:

a detection unit configured to detect closing of a cover that is openable to replace a storing unit moved to the replaceable position, wherein, when the at least one storing unit determined to be lacking the recoding material is moved to the replaceable position by the movement unit and the closing of the cover is detected by the detection unit, the determination unit determines that the at least one storing unit is replaced.

11. The printing apparatus according to claim 10, wherein, when the closing of the cover is detected by the detection unit for each of the plural storing units determined to be lacking the recording material, the determination unit determines that the number of plural storing units determined to be lacking the recording material and the number of storing units determined to be replaced match each other.

12. The printing apparatus according to claim 10, further comprising:

a storage unit configured to store a list indicating whether each of the plural storing units determined to be lacking the recording material has been replaced, wherein, when one of the plural storing units is moved to the replaceable position by the movement unit and the closing of the cover is detected by the detection unit, the determination unit updates the list stored in the storage unit, and wherein, when the list stored in the storage unit indicates that the plural storing units determined to be lacking the recording material have been replaced, the determination unit determines that the number of plural storing units determined to be lacking the recording material and the number of storing units determined to be replaced match each other.

13. The printing apparatus according to claim 10, wherein the movement unit moves one of the plural storing units to the replaceable position and, after the closing of the cover is detected by the detection unit, the movement unit moves another of the plural storing units to the replaceable position.

14. The printing apparatus according to claim 1, wherein the check processing checks whether the storing unit is correctly attached.

15. The printing apparatus according to claim 1, further comprising:

a developing unit configured to develop an image using recording material stored in each of the plurality of storing unit, wherein the plurality of storing units is attached to the developing unit, and wherein the movement unit rotates the developing unit to move one of the plurality of storing units to the replaceable position.

16. The printing apparatus according to claim 1, wherein the check processing checks whether there is a defect.

17. The printing apparatus according to claim 1, wherein the check processing checks whether the storing unit is normally operated.

18. A control method for a printing apparatus for performing printing using a recording material which is stored in at least one of a plurality of storing units configured to store the recording material, the control method comprising:

moving at least one of the plurality of storing units based on determining that the at least one of the plurality of storing units is lacking the recording material;

determining whether a number of plural storing units determined to be lacking the recording material and a number of storing units determined to be replaced match each other; and executing check processing for checking the at least one storing unit based on determining that the number of plural storing units determined to be lacking the recording material and the number of storing units determined to be replaced match each other.

19. A non-transitory computer-readable medium storing a program to cause a printing apparatus to perform the control method according to claim 18.

20. The control method according to claim 18, wherein moving includes moving one of the plural storing units determined to be lacking the recording material to the replacement position based on determining that the number of plural storing units determined to be lacking the recording material and the number of storing units determined to be replaced do not match each other.

21. The control method according to claim 18, further comprising:

detecting closing of a cover that is openable to replace the at least one storing unit moved to the replaceable position, wherein, when the at least one storing unit determined to be lacking the recoding material is moved to the replaceable position and the closing of the cover is detected, the determination unit determines that the at least one storing unit is replaced.

22. The control method according to claim 18, further comprising:

detecting closing of a cover that is openable to replace the at least one storing unit; and storing, in a storage unit, information indicating that the at least one storing unit moved to the replacement position has been replaced in a case where closing of the cover is detected, wherein, when the information stored in the storage unit indicates that the plural storing units determined to be lacking the recording material have been replaced, determining includes determining that the number of plural storing units determined to be lacking the recording material and the number of storing units determined to be replaced match each other.

* * * * *